United States Patent [19]

Yagan

[11] Patent Number: 4,676,755

[45] Date of Patent: Jun. 30, 1987

[54] PEDAL DRIVEN DEVICE

[76] Inventor: Erse Yagan, 3514 West 16th Avenue, Vancouver, British Columbia, Canada, V6R 3C1

[21] Appl. No.: 797,628

[22] Filed: Nov. 13, 1985

[51] Int. Cl.[4] ..... B63H 16/20

[52] U.S. Cl. ..... 440/26; 440/28; 440/31

[58] Field of Search ..... 114/347, 357; 440/26–31, 21

[56] References Cited

U.S. PATENT DOCUMENTS

| | | | |
|---|---|---|---|
| 738,171 | 9/1903 | Dungee | 440/31 |
| 1,370,959 | 3/1921 | Greer | 440/31 |
| 1,473,049 | 11/1923 | Roberts | 440/31 |
| 1,563,922 | 12/1925 | Pohler | 440/31 |
| 1,723,207 | 8/1929 | Puzan | 440/31 |
| 1,773,210 | 8/1930 | Wallace | 114/332 |
| 2,099,544 | 11/1937 | Strezoff | 440/31 |
| 2,239,016 | 4/1941 | Rober | 440/31 |
| 2,627,243 | 2/1953 | Stahmer | 440/28 |
| 3,257,987 | 6/1966 | Liard | 440/31 |
| 3,747,550 | 7/1973 | Stoeberl | 114/357 X |
| 3,987,749 | 10/1976 | Anderson | 440/31 |

FOREIGN PATENT DOCUMENTS

| | | | |
|---|---|---|---|
| 442692 | 3/1925 | Fed. Rep. of Germany | 440/31 |

*Primary Examiner*—Sherman D. Basinger

*Attorney, Agent, or Firm*—Christie, Parker & Hale

[57] ABSTRACT

Pedal operated mechanisms are disclosed for propelling watercraft, with one embodiment of the invention comprising a modification for a canoe and a second form of the invention comprising a mechanism that can be secured to a surfboard. A novel flexible driveshaft is disclosed for transmitting power from the pedals to a propeller. A canoe can easily be modified to incorporate the first form of the invention, and the second form of the invention is easily secured to a surfboard or like craft. Both forms of the invention can be easily removed from the craft, once installed, and the craft converted back to its original use. In the case of the canoe, the invention provides for exercise of different parts of the body in different modes.

6 Claims, 14 Drawing Figures

Fig. 1.
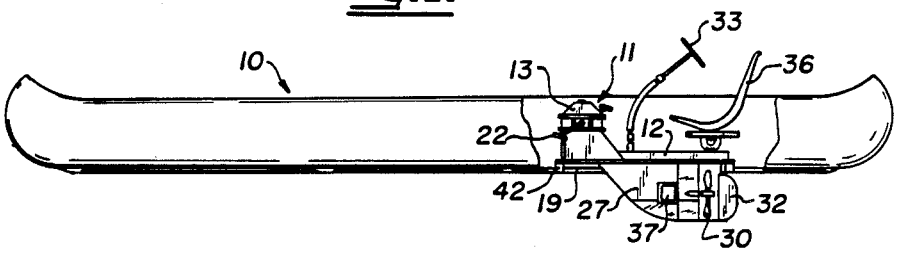
Fig. 5.
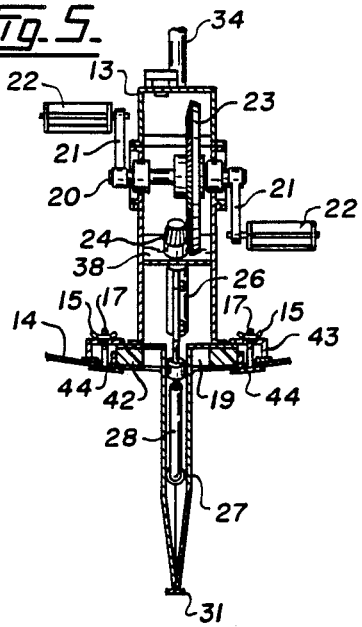
Fig. 6.
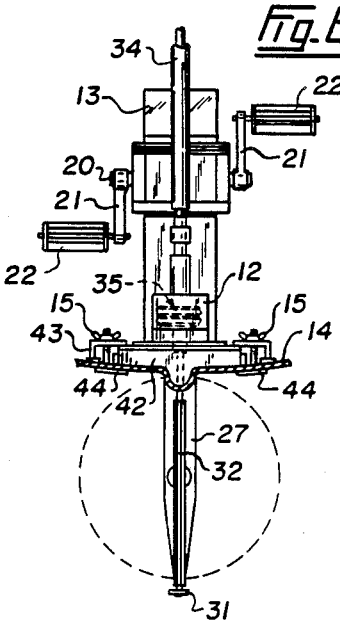
Fig. 10.
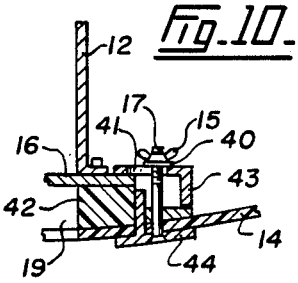
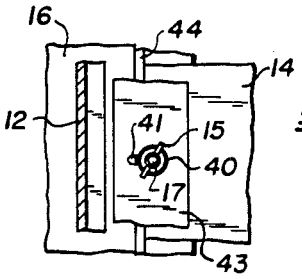
Fig. 11.

33
36
5
11
13
22
34
20
21
23
24
36'
12
35
17
15
16
10
38
25
15
26
42
14
19
37
30
29
4
28
4
32
27
31
5

21
22
13
24
41
43
10
16
17
15
14
39
10
41
21
20
23
28
34
35
43
15
17
22

44
19
25
34
37
17
16
30
43
14
32
44
17
27
28
37
29
43
31

PEDAL DRIVEN DEVICE

FIELD OF THE INVENTION

This invention relates to propelling mechanisms for watercraft.

In particular, the invention relates to propelling mechanisms that can be used to modify existing craft, such as canoes and surfboards, and which are operated by pedalling while the operator is seated in the boat.

DESCRIPTION OF THE PRIOR ART

Numerous mechanisms are known that enable an operator to propel a boat by pedalling. Most of these mechanisms, however, are specially constructed with the boat hull and once the boat is constructed, it cannot readily be used in any other way than by pedalling. An example of such a construction is Liard U.S. Pat. No. 3,257,987 (28/6/66). Some attempts have been made to design mechanisms that can be used to modify an existing hull, but once these mechanisms are in place in the hull they cannot readily be removed so that the boat can be used for other purposes. An example of such a construction is described in Greer U.S. Pat. No. 1,370,959 (8/3/21), in which a driving mechanism is secured to the hull of a boat at one position, and a drive shaft extends through the hull at a second position toward the stern of the boat. The presence of the drive shaft interferes with the usefulness of the space within the boat in this construction. Other examples of like constructions are illustrated in Peterson U.S. Pat. No. 1,319,613 (21/10/19), Strezoff U.S. Pat. No. 2,099,544 (16/11/37), and Rober U.S. Pat. No. 2,239,016 (22/4/41).

SUMMARY OF THE INVENTION

There is a need for a mechanism that can be easily attached to a craft, such as a canoe or surfboard, and subsequently removed and the craft returned to its original state. The present invention seeks to overcome the disadvantages of the prior art and to achieve the above objective.

According to an aspect of the invention, there is provided a pedal operated mechanism for propelling a boat, comprising a housing adapted to be secured to the hull of a boat circumjacent an opening through the hull; transversely extending axle means extending through said housing; a crank attached to each end of said axle, and a pedal secured to each crank, on the outside of the housing; a crown wheel on said axle within the housing and adapted to be rotated with the axle upon operation of the pedals; a pinion journalled within the housing adjacent the crown wheel and rotatable thereby; keel means depending from the housing and adapted to extend through the opening; a flexible driveshaft secured to the pinion for rotation thereby, said driveshaft extending downwardly and rearwardly within the keel and being secured to a propeller shaft extending through a journal at the rear of the keel; and a propeller secured outside the keel to the propeller shaft.

According to another aspect of the invention, there is provided a pedal operated mechanism for propelling a surfboard, comprising a housing adapted to be secured to the surfboard; transversely extending axle means extending through the housing; a crank attached to each end of the axle and a pedal attached to each crank, on the outside of the housing; a crown wheel mounted on the axle within the housing and adapted to be rotated with the axle upon operation of the pedals; a pair of pinions journalled within the housing adjacent the crown wheel and rotatable thereby; a pair of keel means extending laterally outwardly from the housing and then downwardly so as to extend into the water one on each side of the surfboard; a pair of flexible driveshafts, one secured to each pinion, and one passing downwardly and rearwardly through each of the keel means; and a propeller shaft journalled at the rear of each keel, a propeller attached to each propeller shaft, each shaft being secured to its respective driveshaft.

The mechanism of the first aspect of the invention can easily be used in modifying an existing canoe by cutting a hole longitudinally in the hull and installing the device. The mechanism can later be removed, and the hole covered with a suitable hatch to return the canoe to its original condition for use with paddles. The second aspect of the invention is a mechanism that can be secured to, and later removed from, a surfboard so that the latter can be used either with the pedal apparatus or as a surfboard as desired.

DRAWINGS

In the attached drawings, which illustrate two embodiments of the invention:

FIG. 1 is a side elevation of a canoe, partially broken away to illustrate an embodiment of the invention mounted on the hull;

FIG. 5 (sheet 1) is a sectional view on the line 5—5 of FIG. 2;

FIG. 6 (sheet 1) is a rear elevation of the embodiment of FIG. 1;

FIG. 10 (sheet 1) is a section on the line 10—10 in FIG. 3.

FIG. 11 (sheet 1) is a plan of the construction illustrated in FIG. 10;

DESCRIPTION OF THE PREFERRED EMBODIMENTS

Figure 2:
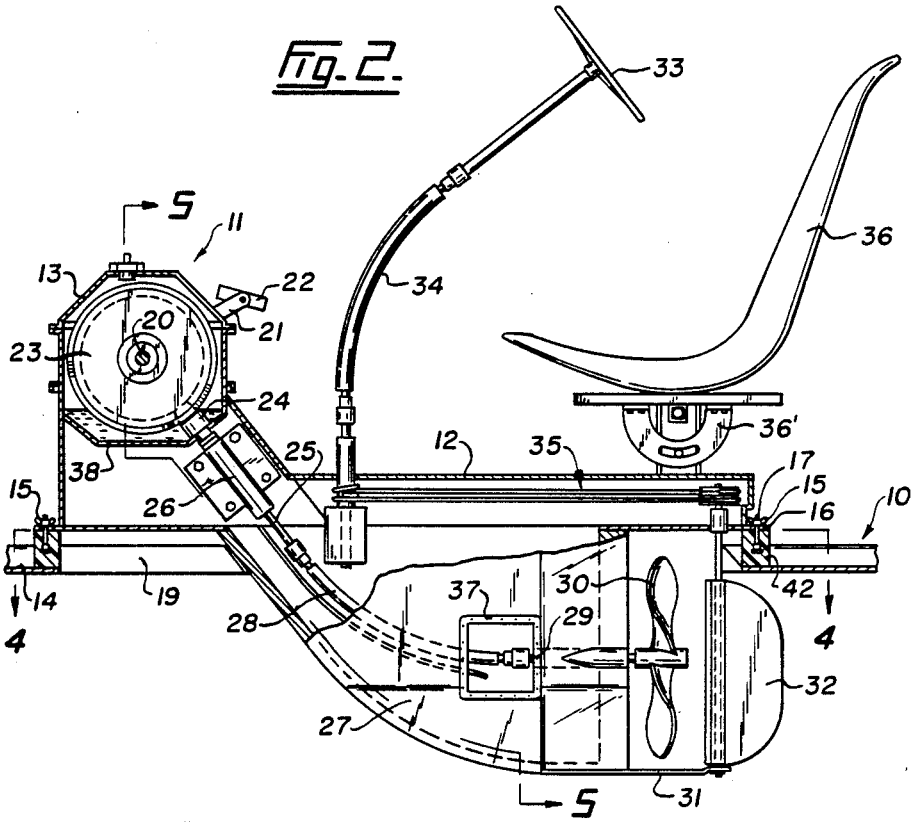
FIG. 2 is a side elevation, partially in section, of the embodiment of FIG. 1.
Figure 3:
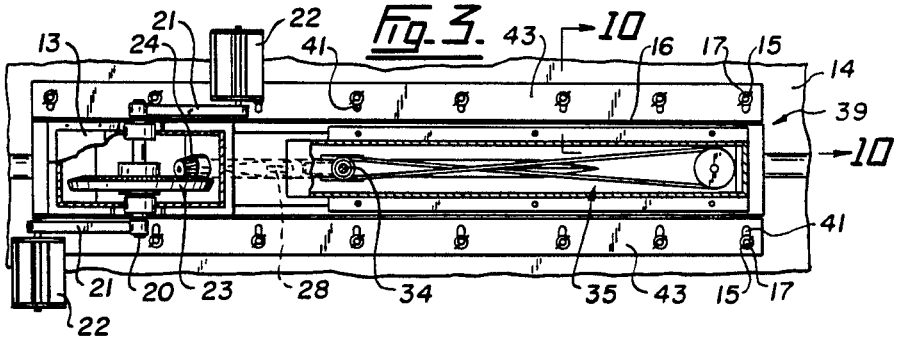
FIG. 3 is a plan view, partially in section, of the embodiment of FIG. 1.
Figure 4:
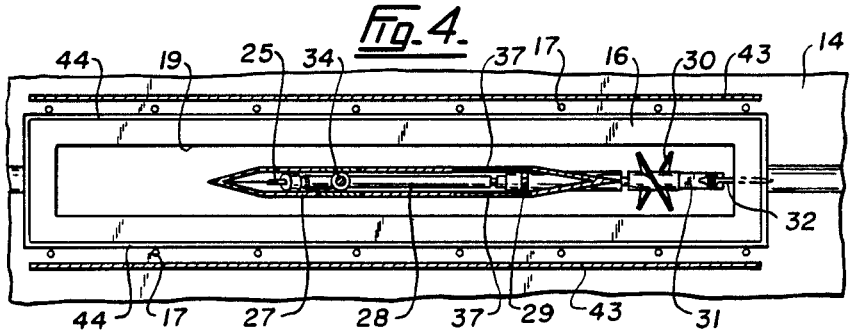
FIG. 4 is a part sectional view of the keel on the line 4—4 of FIG. 2.

In FIG. 1, there is illustrated a canoe 10 which has been modified by the addition of a mechanism 11 according to the invention. A portion of the hull of the canoe is broken away to show the mechanism 11 in position. The mechanism 11 is shown in detail in FIG. 2.

An elongated housing 12 having an upstanding frontal portion 13 is shown secured to the hull 14 of the canoe 10 by wingnuts 15. The housing 12, which may be made of metal, is provided with an outwardly extending flange 16 which is used to secure the mechanism 11 to a hull in a manner to be described below. The elongated housing 12 is desirable so that stress is evenly distributed along the hull of the boat, reducing the possibility of leakage bearing in mind that the seat 36 is mounted on the apparatus, creating a substantial load.

Within the upstanding portion 13 of the housing 12 there is journalled a shaft 20 having at each end thereof, on the outside of the housing, a crank 21 upon which is mounted a pedal 22. Within the housing, and firmly secured to the shaft 20, is a crown wheel 23 which may be formed of a strong plastic material, or of metal, as would be obvious to a person skilled in the art. The crown wheel 23 drives a pinion 24 which is secured to a shaft 25 mounted in a journal 26 bolted to the inside of the housing. Secured to and depending from the housing is a keel 27, which may be formed of a suitable plastic material partially filled with foamed plastic for buoyancy. Through the housing 12 there extends a flexible driveshaft 28 which extends downwardly and rearwardly to a propeller shaft 29 that is journalled at the rear of the keel and to which there is attached a propeller 30. On an extension 31 of the keel 27 there is mounted a rudder 32 which is operated by the steering wheel 33, flexible driveshaft 34, and pulley arrangement 35 also illustrated in FIG. 2. In use, the operator would be seated on the seat 36, would operate the pedals 22 with his feet, and steer the canoe 10 by using the steering wheel 33, as will be obvious. The seat 36 may be tilted by a suitable tilting means 36', which does not form part of the invention and is therefore not described in detail.

FIG. 10 illustrates how the mechanism 11 is secured to the hull of a boat. Around the opening 19 in the hull of a boat (FIG. 10) there is mounted a rectangular frame 39 comprising a continuous inverted T-shaped section 44, suitably formed from aluminum, through which bolts 17 extend. The mechanism 11 is secured within the opening defined by the inside of the T-shaped element, and is held in place by an angle bar 43 also formed from aluminum extending along each side of the mechanism 11. Slots 41 in the angle bar receive the bolts 17, and washers 40 and wing nuts 15 are mounted on the bolts. In the position shown in FIG. 10, the angle bar 43 together with the bolts 17 and wing nuts 15 clamp down on the flange 16 of housing 12 to hold the mechanism 11 securely in place. If the wing nuts 15 are loosened the angle bar 43 can be slid to the right as illustrated in FIG. 10 to release the mechanism 11 for removal from the boat. Gasket material 42 ensures that the mechanism 11 seals properly against the inside of the T-shaped section to prevent leaks.

For construction and maintenance purposes, there is provided in one side of the keel an access hatch 37.

It will be understood that if it is desired to use the canoe in the conventional manner, the above mechanism can easily be removed by removing the wingnuts 15, and replaced with a rectangular plate (not shown) to seal the hull and make it suitable for normal use.

A tray 38 in the upstanding portion 13 of the housing 12 may be used to hold lubricant for the crown wheel teeth.

Figure 7:
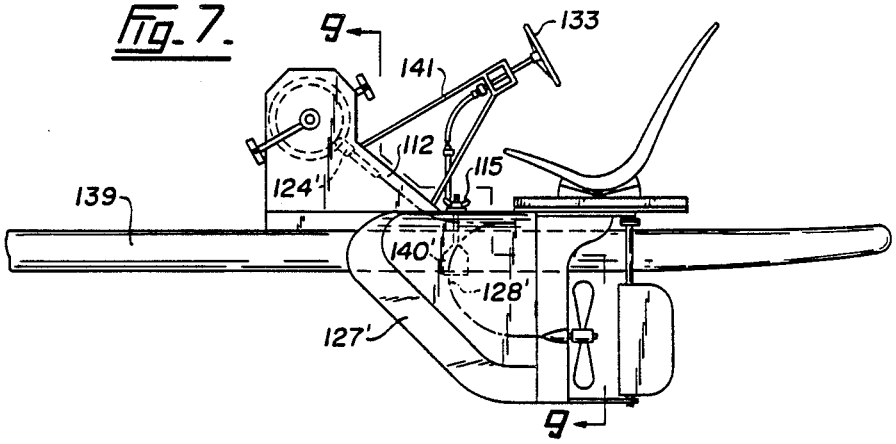
FIG. 7 is a side elevation of a second embodiment mounted on a surfboard.
Figure 8:
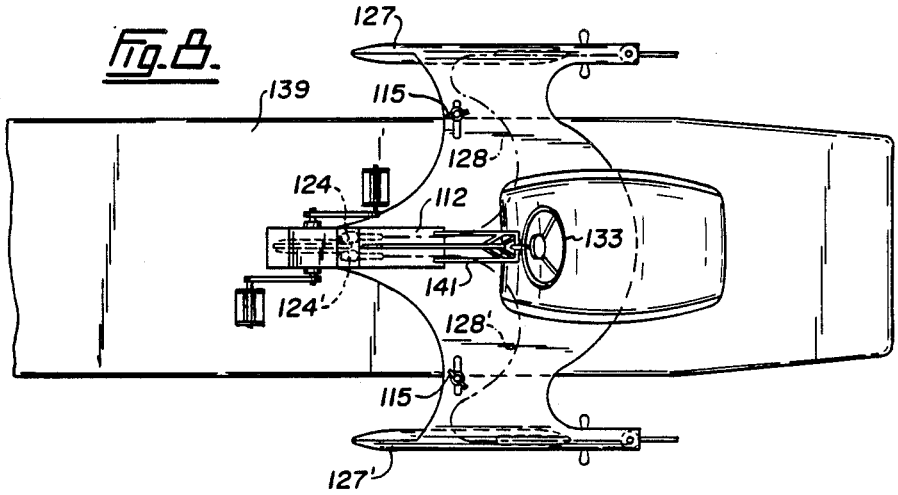
FIG. 8 is a plan of the embodiment of FIG. 7.
Figure 9:
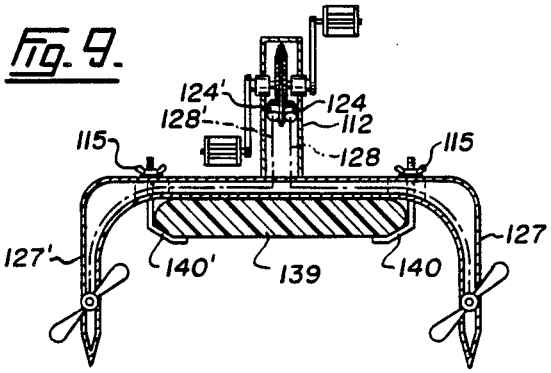
FIG. 9 is a section taken on the line 9—9 of FIG. 7.

In the second embodiment of the invention (FIGS. 7, 8, 9) essentially the same construction is used as described above, however, there are two keels 127, 127' each extending from the housing 112 outwardly and downwardly. As illustrated in FIG. 9, the downwardly extending portions of the keels are spaced apart far enough that a surfboard 139 may be clamped by clamp means 140, 140' secured by wingnuts 115 between the two downwardly extending portions of the keel. The construction is similar to the construction of the embodiment of FIGS. 1 through 6 excepting that two separate pinions 124, 124' and flexible driveshafts 128, 128' are provided, with one of the driveshafts extending downwardly and rearwardly through each of the two separate keels. The steering wheel 133 is also mounted on a frame 141. Since the buoyancy and resistance to roll of a surfboard is relatively low, it may be more important in the construction of FIGS. 7 through 9 to use plastic material for the keels, filled with foamed plastic excepting where the driveshafts pass through the keels for buoyancy and stability.

Figure 12:
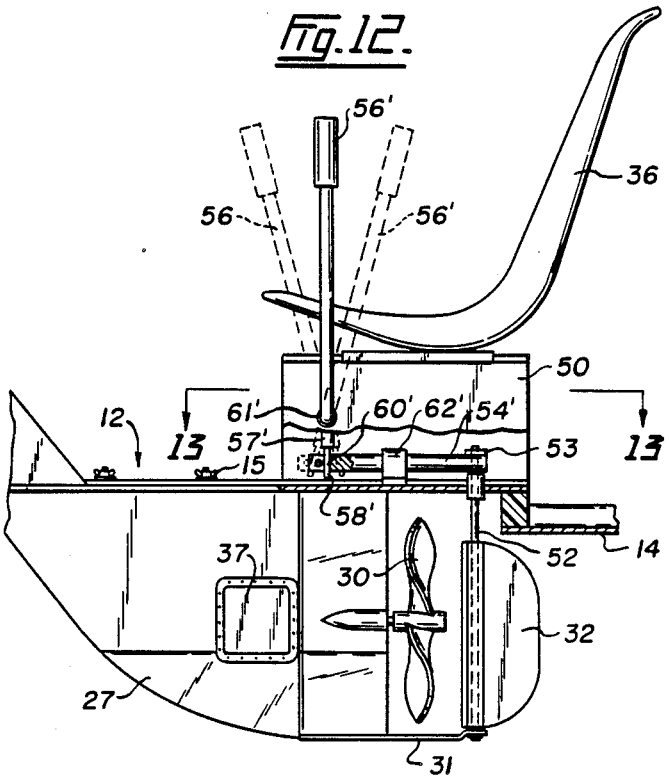
FIG. 12 is an illustration of an alternative steering arrangement.
Figure 13:
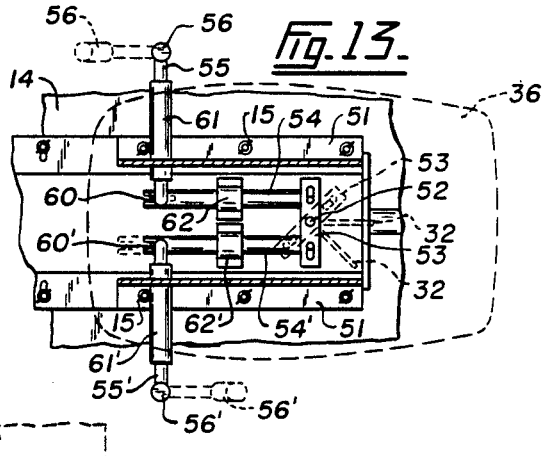
FIG. 13 is a section on the line 13—13 of FIG. 12.
Figure 14:
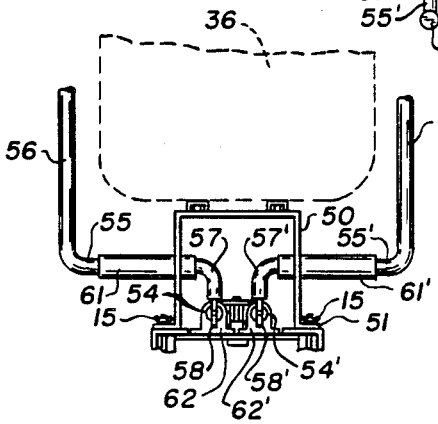
FIG. 14 is a detail view of the construction of FIGS. 12 and 13.

FIGS. 12, 13 and 14 illustrate an alternative steering arrangement. In this embodiment, the seat 36 is mounted on an inverted channel 50 having outwardly turned flanges 51 that can be secured to the housing 12 using the same wing nuts 15 as are used for securing the mechanism 11 to the boat hull 14. The rudder 32 is mounted in the housing 12 in the same manner as in the embodiment of FIG. 1. To the steering shaft 52 of the rudder 32 there is secured a transverse rocker 53 to each end of which there is pivoted a forwardly extending arm 54, 54' in a sleeve 61, 61'.

Journalled on each side of the channel 50 is a crank 55, 55' each having an upwardly extending handle portion 56, 56', a tranversely extending shaft 57, 57' and a downwardly extending element 58, 58' that engages loosely in openings 60, 60' in the ends of the arms. The arms 54, 54' are restrained to longitudinal movement by brackets 62, 62' secured to the top of the housing 12. Since the downwardly extending elements 58, 58' are a loose fit in the openings 60, 60' the seat and its support can be lifted from the housing without difficulty. Movement of the handles 56, 56' in equal and opposite directions moves the arms 54, 54' in like equal and opposite directions to rotate the rocker 53 and thus the rudder 32. The seat 36 may slide in known manner on the top of the channel 50.

It will be appreciated that the use of the flexible driveshaft and the integral propeller, keel and rudder assembly provides for a light, simple and cheap device for the modification of an existing boat, enabling a user to exercise different parts of his body, at will, by attaching or removing the device to a single hull.

I claim:

1. A pedal operated mechanism for propelling a boat, comprising:

(i) a housing adapted to be secured to the hull of a boat circumjacent an opening through the hull;

(ii) transversely extending axle means extending through said housing;

(iii) a crank attached to each end of said axle, and a pedal secured to each crank, on the outside of the housing;

(iv) a crown wheel on said axle within the housing and adapted to be rotated with the axle upon operation of the pedals;

(v) a pinion journalled within the housing adjacent the crown wheel and rotatable thereby;

(vi) keel means depending from the housing and adapted to extend through the opening;

(vii) a flexible driveshaft secured to the pinion for rotation thereby, said driveshaft extending downwardly and rearwardly within the keel and being secured to a propeller shaft extending through a journal at the rear of the keel, said keel means substantially enclosing said flexible drive shaft; and (viii) a propeller secured outside the keel to the propeller shaft.

2. A pedal operated mechanism for propelling a surfboard, comprising:

(i) a housing adapted to be secured to the surfboard;

(ii) transversely extending axle means extending through the housing;

(iii) a crank attached to each end of the axle and a pedal attached to each crank, on the outside of the housing;

(iv) a crown wheel mounted on the axle within the housing and adapted to be rotated with the axle upon operation of the pedals;

(v) a pair of pinions journalled within the housing adjacent the crown wheel and rotatable thereby;

(vi) a pair of keel means extending laterally outwardly from the housing and then downwardly so as to extend into the water one on each side of the surfboard;

(vii) a pair of flexible driveshafts, one secured to each pinion, and one passing downwardly and rearwardly through each of the keel means; and (viii) a propeller shaft journalled at the rear of each keel, a propeller attached to each propeller shaft, each shaft being secured to its respective driveshaft.

3. A pedal operated mechanism as claimed in claim 1 or 2 wherein the keel means are formed of a suitable plastic material a portion of the interior of the keel means being filled with foamed plastic.

4. A pedal operated mechanism as claimed in claim 1 or 2 further including a seat secured to the rear of the housing.

5. A pedal operated mechanism as claimed in claim 1 wherein the housing is elongated to strengthen the hull in the area of the opening.

6. A pedal operated mechanism as claimed in claim 1 or claim 5 wherein a frame is secured to the hull around the opening, and the housing being securable to the frame by bolts and wing nuts to facilitate installation of the mechanism.

* * * * *